US011774051B2

(12) United States Patent
Yang

(10) Patent No.: US 11,774,051 B2
(45) Date of Patent: Oct. 3, 2023

(54) LIGHT EMITTING DIODE LAMP STRING OF EASY WELDING, ASSEMBLY AND INJECTION

(71) Applicant: Dongguan Zhengyi Photoelectric Technology Co., Ltd, Dongguan (CN)

(72) Inventor: Fude Yang, Dongguan (CN)

(73) Assignee: DONGGUAN ZHENGYI PHOTOELECTRIC TECHNOLOGY CO., LTD, Dongguan (CN)

( * ) Notice: Subject to any disclaimer, the term of this patent is extended or adjusted under 35 U.S.C. 154(b) by 49 days.

(21) Appl. No.: 17/675,216

(22) Filed: Feb. 18, 2022

(65) Prior Publication Data

US 2023/0128859 A1 Apr. 27, 2023

(30) Foreign Application Priority Data

Oct. 22, 2021 (CN) ..... 202122553139.7

(51) Int. Cl.

| | |
|---|---|
| ***F21S 4/10*** | (2016.01) |
| ***F21V 23/00*** | (2015.01) |
| ***F21V 23/06*** | (2006.01) |
| ***H05B 45/30*** | (2020.01) |
| *F21Y 115/10* | (2016.01) |

(52) U.S. Cl.

CPC ..... *F21S 4/10* (2016.01); *F21V 23/003* (2013.01); *F21V 23/06* (2013.01); *F21Y 2115/10* (2016.08); *H05B 45/30* (2020.01)

(58) Field of Classification Search

None

See application file for complete search history.

(56) References Cited

U.S. PATENT DOCUMENTS

2013/0076256 A1* 3/2013 Yang ..... H05B 47/18 315/201

FOREIGN PATENT DOCUMENTS

CA 2644034 A1 * 9/2007
WO WO-2018086179 A1 * 5/2018

* cited by examiner

*Primary Examiner* — Anh Q Tran
(74) *Attorney, Agent, or Firm* — WPAT, P.C

(57) ABSTRACT

A LED lamp string of easy welding, assembly and injection includes at least one rectifier, and multiple LED modules connected in series between positive and negative output ends of the at least one rectifier. Each LED module includes a first PCB, and the first PCB is provided with multiple first welding positions. The first welding positions are welded with a lamp bead and wires thereon. The lamp bead is connected to first ends of the wires, and a second end of the one wire of each LED module is directly connected to the at least one rectifier or is connected to the at least one rectifier after passing through at least one other LED module. It can realize the large-scale production of the welding equipment instead of manual welding, greatly improve the efficiency of the production, avoid false welding and improve the yield rate.

15 Claims, 4 Drawing Sheets

LIGHT EMITTING DIODE LAMP STRING OF EASY WELDING, ASSEMBLY AND INJECTION

TECHNICAL FIELD

The disclosure relates to the technical field of light emitting diodes (LEDs), and more particularly to a LED lamp string (also referred to as LED light string) of easy welding, assembly and injection.

BACKGROUND

The light emitting diode, called as LED for short, is a common light-emitting device. It releases energy through electrons recombining with holes. It is widely used in the lighting field. Usually, multiple LEDs are connected in series to form a lamp string for decoration.

The existing LED lamp string has the following problems in the production process:

1. Because pins of the LED lamp bead are relatively thin and soft, the pins of the LED lamp bead are easy to shift during welding by equipment, resulting in false welding. Therefore, the existing processing methods generally use manual connection of single LED lamp bead, which is inefficient.
2. When there are no auxiliary components in the circuit structure and one LED is damaged due to breakage/damage/open circuit of the series circuit, the whole LED lamp string cannot work.
3. The rectifiers are scattered, the material preparation is troublesome, the efficiency of the assembly staffs is backward, and the quality is easy to go wrong.
4. It also takes a lot of time to identify the wiring relationship of each pin when welding the rectifiers. The assembly of the rectifiers is troublesome, the production efficiency is low, and it is difficult to realize the automation and semi-automation process.

SUMMARY

An objective of the disclosure is to provide an LED lamp string of easy welding, assembly and injection, so as to solve the problems in the above prior art.

In order to achieve the above objective, the disclosure provides the technical scheme:

A LED lamp string of easy welding, assembly and injection includes: at least one rectifier (also referred to as rectifier module) and a plurality of LED modules; the plurality of LED modules are connected in series between positive and negative output ends of the at least one rectifier; each of the plurality of LED modules includes a first printed circuit board (PCB), the first PCB is provided with a plurality of first welding positions (also referred to as first fixed welding positions), the plurality of first welding positions are welded with a lamp bead and wires thereon, the lamp bead is electrically connected to first ends of the wires; and a second end of one of the wires of each of the plurality of LED modules is directly connected to the at least one rectifier or is connected to the at least one rectifier after passing through at least one other LED module of the plurality of LED modules.

In an embodiment, the first PCB is further welded with a resistor thereon and the resistor is connected in series between one of the wires and the lamp bead.

In an embodiment, adjacent two of the plurality of LED modules are connected in series.

In an embodiment, the first PCB is further welded with bypass (BP) diodes and the BP diodes are connected in parallel with the lamp bead.

In an embodiment, a number of the at least one rectifier is one and the one rectifier is a bridge rectifier circuit.

In an embodiment, a number of the at least one rectifier is multiple, the plurality of LED modules are disposed between adjacent two of the multiple rectifiers, and the adjacent two of the multiple rectifiers together form a bridge rectifier circuit.

In an embodiment, each of the multiple rectifiers includes a second PCB, the second PCB is provided with a plurality of second welding positions (also referred to as second fixed welding positions), the plurality of second welding positions are welded with a first diode and a second diode, and the first diode and the second diode are arranged in one of an output-to-output manner (also referred to as face-to-face manner) and an input-to-input manner (also referred to as back-to-back manner).

In an embodiment, each of the plurality of LED modules further includes an insulating housing, the first PCB and the lamp bead are embedded and fixed in the insulating housing, and the lamp bead is exposed from the insulating housing.

In an embodiment, one of the at least one rectifier at one end of the LED lamp string is connected with one of a male plug and a female plug, and another of the at least one rectifier at the other end of the LED lamp string is connected with the other one of the male plug and the female plug.

A method for producing the above LED lamp string, includes:

step 1, forming a metal circuit and the plurality of first welding positions on each first PCB, and forming a metal circuit and a plurality of second welding positions on each second PCB;

step 2, welding the resistor and the BP diodes to the plurality of first welding positions of each first PCB through a welding equipment to form a target first PCB, and thereby obtaining a plurality of target first PCBs of the plurality of LED modules;

step 3, welding a plurality of diodes (such as first diode and second diode) to the plurality of second welding positions of each second PCB through the welding equipment to form the rectifier together with the second PCB, and thereby obtaining the plurality of rectifiers;

step 4, placing the plurality of rectifiers and the plurality of target first PCBs on a welding fixture to make the plurality of target first PCBs be located between the two adjacent rectifiers, and then clamping a plurality of wires and a plurality of lamp beads on the welding fixture; each lamp bead corresponds to ones of the plurality of first welding positions of the target first PCB, and each wire includes a plurality of connection ends, the plurality of connecting ends of the plurality of wires correspond to different ones of the plurality of first welding positions of the plurality of target first PCBs and the plurality of second welding positions of the plurality of second PCBs; and welding each of the plurality of lamp beads to the ones of the plurality of first welding positions of corresponding one of the plurality of target first PCBs through the welding equipment, and welding the plurality of connecting ends of the plurality of wires to the different ones of the plurality of first welding positions of the plurality of target first PCBs and the plurality of second welding positions of the plurality of second PCBs (20).

The beneficial effects of the disclosure are:

1. Using the first PCB as the intermediate connection medium, the weldability area is increased, the lamp bead has a fixed welding position, it is easier to connect the lamp bead with the wire, more importantly, due to the increase of the weldability area, through the tin climbing effect in the welding, the situation that the pins of lamp bead is relatively thin and soft, which is easy to cause the pins to shift and lead to false welding can be overcome, and the large-scale production of welding equipment can be realized instead of manual welding, which greatly improves the production efficiency, avoids the occurrence of false soldering and improves the yield rate.
2. by forming the LED module and the rectifier, the wire can be welded on the first welding position and the second welding position respectively during production, which greatly improves the convenience and accuracy of welding compared with the traditional way of welding scattered parts one by one, and the integrated module production is more conducive to the production with automatic equipment, so as to replace manual work, greatly improve the production efficiency.
3. By setting the resistor such as thermistor/BP diodes in parallel on each first PCB, when a single lamp bead is damaged/open circuit occurs in the series circuit, other lamp beads still work normally.

Other features and advantages of the disclosure will be described in detail in the following specific embodiments.

DETAILED DESCRIPTION OF EMBODIMENTS

Figure 1:
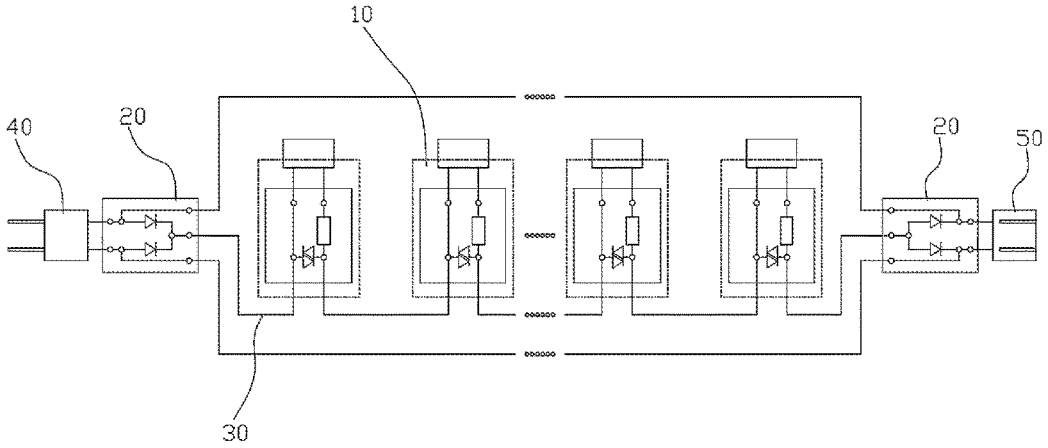
FIG. 1 is a schematic diagram of a LED lamp string according to an embodiment of the disclosure.

The technical scheme in the embodiment of the disclosure will be clearly and completely described below in combination with the accompanying drawings in the embodiment of the disclosure.

When a number of LED modules 10 is small, it is also possible to use a bridge rectifier circuit to convert alternating current (AC) to direct current (DC). For example, if ten number of LED modules 10 are connected in series, each LED module 10 can be lighted up by enough voltage, which is realizable as per experiments. Alternatively, referring to FIG. 1, the rectifier bridge circuit is divided into two rectifiers 20, and the LED modules 10 connected in series is disposed between the two rectifiers 20, which is another rectifier form. Often, there are more than ten number of LED modules 10 in the LED lamp string in life, and there may be more than 20 number of LED modules, referring to FIG. 2, the voltage obtained by each LED module 10 is not enough to be lighted up or the brightness of the LED module 10 is not enough. In order to solve the above problems, several LED modules 10 are connected in series to form a group. For example, four number of LED modules are connected in series, and then the bridge rectifier circuit is divided into two parts, each of the two parts is one rectifier 20. The LED modules 10 connected in series is connected between the two rectifiers 20. The LED lamp string has several rectifiers 20 and several groups of the LED modules 10. The adjacent two rectifiers 20 together form the bridge rectifier circuit, while several groups of the LED modules 10 are connected in parallel to rectify each group of the LED modules 10. In this way, the LED module 10 in each group can obtain sufficient voltage and be lighted up. In addition, the rectifier 20 and LED module 10 can be pre-produced to form separate individuals respectively, when connecting between the rectifier 20 and LED module 10, it can realize modular installation, simple operation, improve automation productivity, effectively improve production efficiency, and improve the yield rate of good products and the maintenance efficiency of bad products.

The LED module 10 will be described below with reference to FIGS. 3 and 4.

The first PCB 11 is used as a bearing board, in which a connecting circuit and several first welding positions 12 can be formed on the first PCB 11 through the existing producing process. During the producing, several first PCBs 11 can be orderly arranged in the welding equipment, and then each of several lamp beads 13 can also be placed in the welding equipment and corresponds to the position of the first welding positions 12 of corresponding one first PCB 11, finally, the first PCB 11 and the pins of the lamp bead 13 are welded together to form a single LED module 10. After the LED module is formed, the rectifier 20 and the LED module 10 can be connected together through the wires 30 by the welding equipment during assembly and production, one end of the wire 30 is connected with the first welding position 12 and the other end of the wire is connected with the rectifier 20.

Using the first PCB 11 as the intermediate connection medium, the weldability area is increased, the lamp bead 13 has a fixed welding position, and it is easier to connect the lamp bead 13 with the wire 30; more importantly, due to the increase of the weldability area, through the tin climbing effect in the welding, the situation that the pins of lamp bead 13 is relatively thin and soft, which is easy to cause the pins to shift and lead to false welding can be overcome, and the large-scale production of welding equipment can be realized instead of manual welding, which greatly improves the production efficiency, avoids the occurrence of false soldering and improves the yield rate.

In addition, the resistor 14 connected in series with the wire 30 and the lamp bead 13 and the BP diodes 15 (also referred to as diode AC switch, DIAC) connected in parallel with the lamp bead 13 are welded on the first PCB 11, the temperature control of each lamp bead 13 is homogenized through the resistor 14 (the previous process was that the temperature of the resistor 14 was concentrated on several lamp beads, but now it is evenly distributed on each lamp bead), it can improve the efficiency of developing products in batches. By setting the BP diodes 15 in parallel on each first PCB 11, when a single lamp bead is damaged/open circuit occurs in the series circuit, other lamp beads still work normally.

Figure 3:
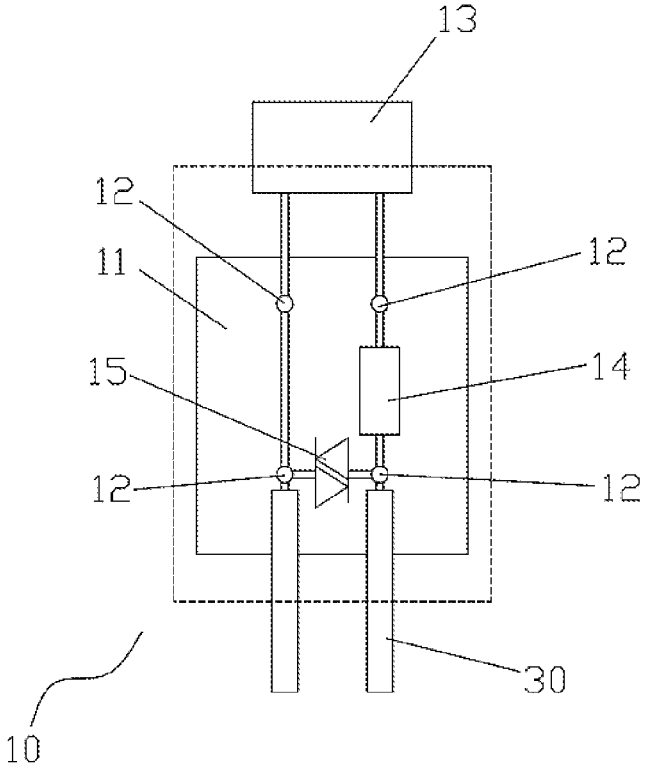
FIG. 3 is a schematic diagram of a LED module according to an embodiment of the disclosure.
Figure 4:
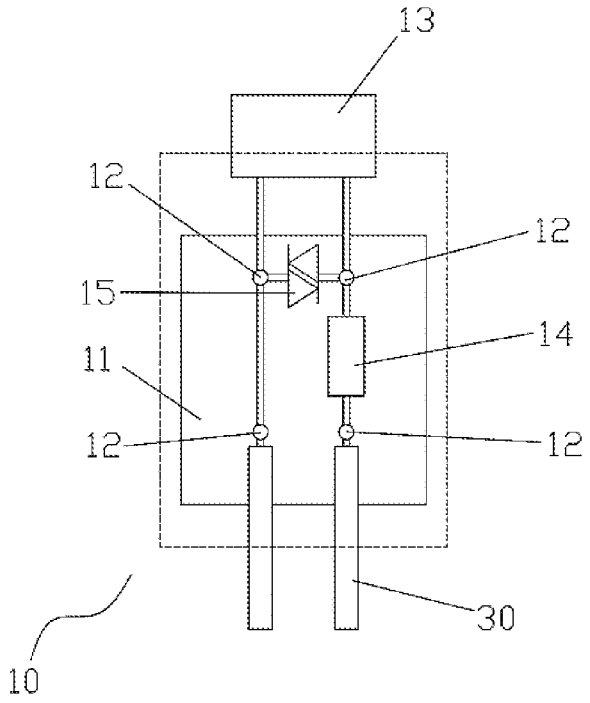
FIG. 4 is a schematic diagram of another LED module according to an embodiment of the disclosure.

It should be noted that the BP diodes 15 have two connection modes;

As shown in FIG. 3, the first mode: the BP diodes 15 are connected in parallel with the lamp bead 13 and the resistor. When the lamp bead 13 is damaged, the BP diodes 15 are turned on and the current does not pass through the resistor 14;

As shown in FIG. 4, in the second mode, the BP diodes 15 are connected in parallel with the lamp bead 13 and then connected in series with the resistor 14. When the lamp bead 13 is damaged, the current passes through the resistor 14.

Figure 2:
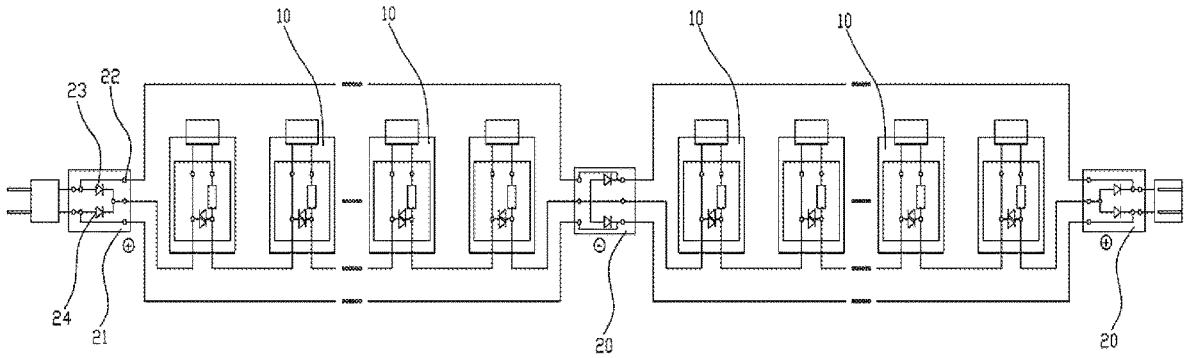
FIG. 2 is a schematic diagram of another LED lamp string according to an embodiment of the disclosure.
Figure 5:
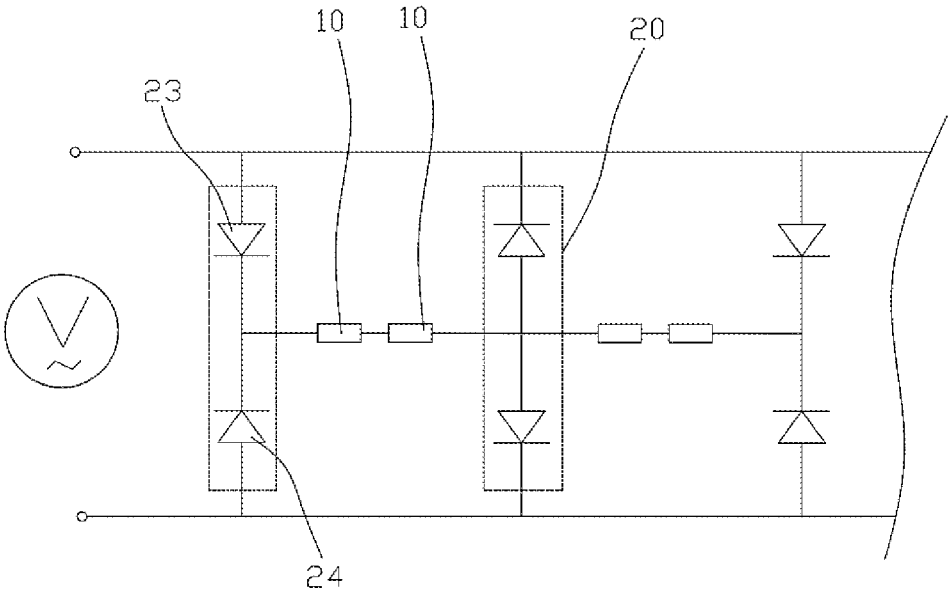
FIG. 5 is a schematic diagram of a rectifier according to an embodiment of the disclosure.

The rectifier 20 will be described below with reference to FIGS. 2 and 5.

Two adjacent rectifiers 20 are connected to together form the rectifier bridge circuit, that is, each rectifier 20 has at least one diode. In this embodiment, each rectifier 20 contains two diodes (first diode and second diode) and the second PCB 21. Similarly, the prior art process can be adopted to form the required circuit and the second welding positions 22 on the second PCB 21, the first diode 23 and the second diode 24 are welded on the second welding position 22 through the automatic welding equipment to form an independent rectifier module 20, and the circuit on the second PCB 21 is clear. The first diode 23 and the second diode 24 can be welded in a fixed position correspondingly, which saves the time to identify the connection relationship of pins, the operation is very convenient and can effectively improve the production efficiency. In addition, the setting of the second PCB 21 increases the weldability area, so that the diode can be produced by welding equipment, which is convenient for automatic or semi-automatic production.

Since the two rectifiers 20 form the complete bridge rectifier circuit, when the two diodes in the first rectifier 20 of the two rectifiers are arranged in an input-to-input manner, the two diodes in the second rectifier 20 of the two rectifiers are arranged in an output-to-output manner, and so on, and vice versa, in this way, the two adjacent rectifiers 20 can form the complete bridge rectifier circuit.

The following describes the specific working principle, in which the direction of the arrow is the flow direction of the current, and the serial number is marked on each diode for convenience of description. Specifically, negative poles of diode ① and diode ② are arranged opposite, i.e. the diode ① and diode ② are arranged in a face-to-face manner, the output ends of the diode ① and the diode ② are connected each other, positive poles of diode ③ and diode ④ are arranged opposite, i.e. the diode ③ and the diode ④ are arranged in a back-to-back manner, the input ends of the diode ③ and the diode ④ are connected each other, negative poles of diode ⑤ and diode ⑥ are arranged opposite, i.e. the diode ⑤ and the diode ⑥ are arranged in the face-to-face manner, the output ends of the diode ⑤ and the diode ⑥ are connected each other, which is arranged circularly, and then the output end formed by the diode ① and the diode ② is connected with the input end of first electrical appliance, the output end of first electrical appliance is connected with the input end formed by the diode ③ and the diode ④, the output end of second electrical appliance is connected with the input end formed by the diode ③ and the diode ④, and the input end of the second electrical appliance is connected with the output end formed by the diode ⑤ and the diode ⑥, the electrical appliances are arranged in such a cycle, the input end of the diode ① is connected with the output end of the diode ③, the output end of the diode ③ is connected with the input end of the diode ⑤, the input end of the diode ② is connected with the output end of the diode ④, and the output end of the diode ④ is connected with the input end of the diode ⑥.

Figure 6:
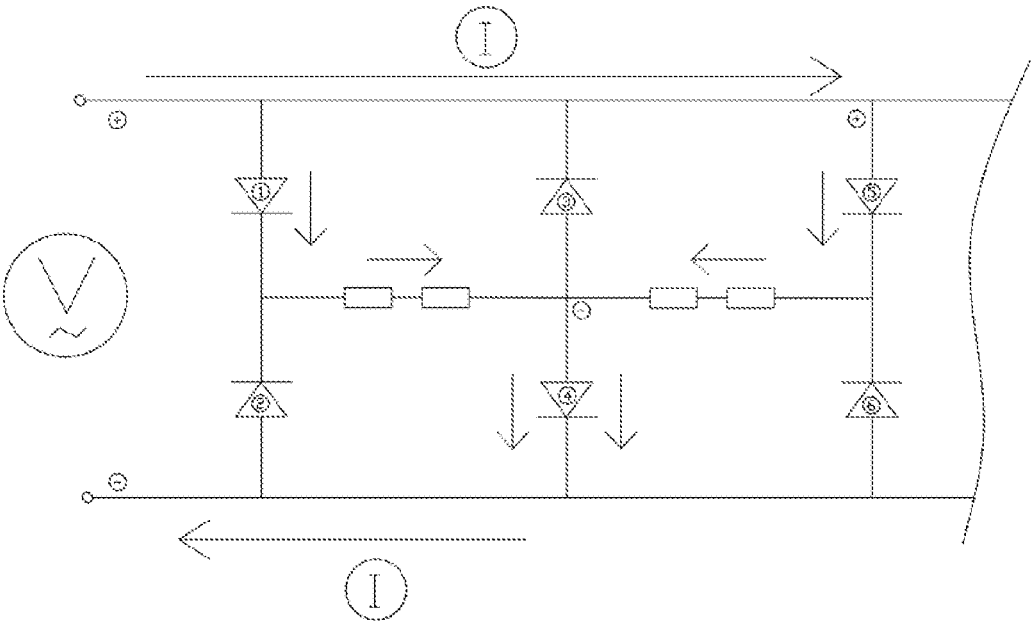
FIG. 6 is a schematic diagram of a rectification process according to an embodiment of the disclosure.

Referring to FIG. 6, when conducting in the forward direction, the current is inputted from the diode ① and the diode ⑤, and outputted from the output ends of the diode ① and the diode ⑤, and flows to the first electrical appliance and the second electrical appliance respectively. The current converges at the output ends of the first electrical appliance and the second electrical appliance, and finally the current flows to the diode ④ and returns to the negative pole of the power supply.

Figure 7:
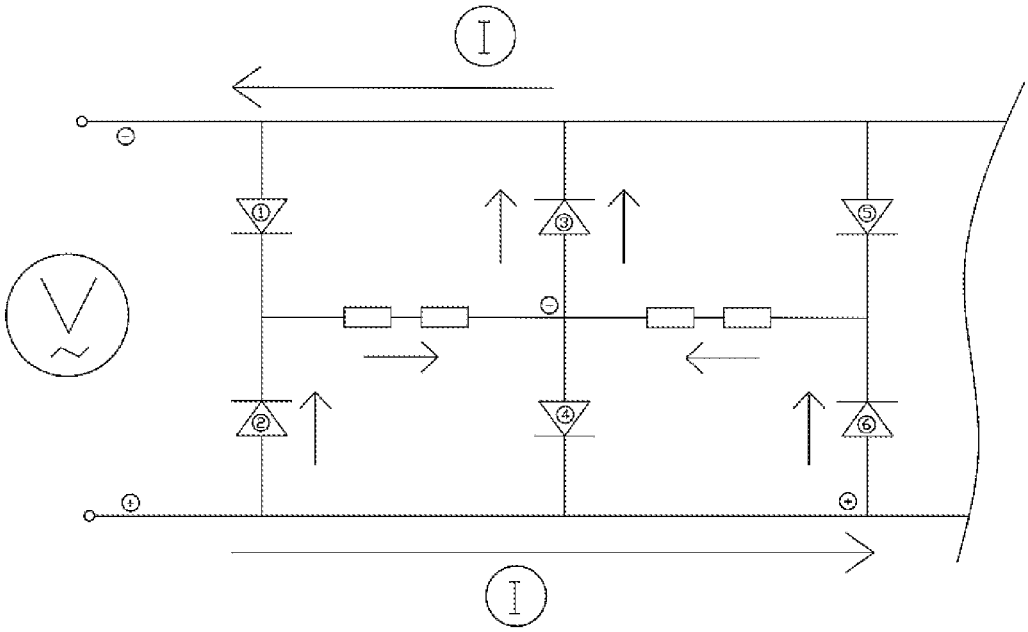
FIG. 7 is a schematic diagram of another rectification process according to an embodiment of the disclosure.

Referring to FIG. 7, when conducting in reverse direction, the current is inputted from the diode ② and the diode ⑥, and outputted from the output ends of the diode ② and the diode ⑥, and flows to the first electrical appliance and the second electrical appliance respectively. The current converges at output ends of the first electrical appliance and the second electrical appliance, and finally the current flows to the diode ③ and returns to the negative pole of the power supply.

Through the above principles, it is proved that the diode ①, the diode ②, the diode ③ and the diode ④ form the complete bridge rectifier circuit, and the diode ③, the diode ④, the diode ⑤ and the diode ⑥ form the complete bridge rectifier circuit, that is, the diode ③ and the diode ④ are common parts.

To sum up, by forming the LED module 10 and the rectifier 20, the wire 30 can be welded on the first welding position 12 and the second welding position 22 respectively during production, which greatly improves the convenience and accuracy of welding compared with the traditional way of welding scattered parts one by one, and the integrated module production is more conducive to the production with automatic equipment, so as to replace manual work, greatly improve the production efficiency.

Figure 8:
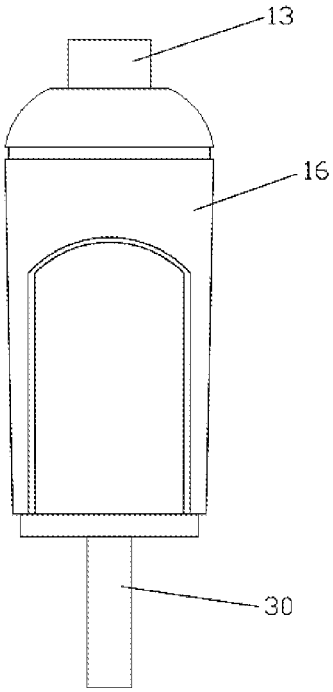
FIG. 8 is a schematic diagram of a package of the lamp bead according to an embodiment of the disclosure.

Finally, referring to FIGS. 1 and 8, after the rectifiers 20 and the LED modules 10 are connected, an insulating housing 16 is formed on the first PCB 11 and the lamp bead 13 by injection molding, and the lamp bead 13 is exposed from the insulating housing 16, the rectifier 20 at one end of the LED lamp string is connected with one of a male plug 40 and a female plug 50, and the rectifier 20 at the other end of the LED lamp string is connected with the other one of the female plug 50 and the male plug 40.

A method for producing the above LED lamp string is also provided, the method includes:

- step 1, forming a metal circuit and the plurality of first welding positions 12 on the first PCB 11, and forming another metal circuit and the plurality of second welding positions 22 on the second PCB 21;
- step 2, welding the resistor 14 and the BP diodes 15 to the first welding positions of the first PCB 11 through the welding equipment to form a target first PCB and thereby obtaining a plurality of target first PCBs;
- step 3, welding several diodes to the second welding positions 22 of the second PCB 21 through the welding equipment to form the rectifier 20 together with the second PCB 21;
- step 4: placing the plurality of rectifiers 20 and the plurality of target first PCBs on the welding fixture, the plurality of target first PCBs are located between the two adjacent rectifiers 20, and then, clamping the plurality of wires 30 and the plurality of lamp beads 13 on the welding fixture, each lamp bead 13 corresponds to the first welding positions 12 of corresponding one first PCB 11, and each wire 30 includes a plurality of connection ends, the plurality of connecting ends of the plurality of wires 30 correspond to different ones of the plurality of first welding positions 12 of the plurality of target first PCBs and the plurality of second welding positions 22 of the plurality of second PCBs.

step 5, welding the plurality of lamp beads 13 on different first welding positions of the plurality of target first PCBs through the welding equipment, and welding the plurality of connecting ends of the plurality of wires 30 to the different ones of the plurality of first welding positions 12 of the plurality of target first PCBs and the plurality of second welding positions 22 of the plurality of second PCBs 20.

By using the PCB board as the bearing, the originally scattered parts are formed into a module before production, and the welding position formed on the PCB expands the welding area, making it easier for the wire to be welded with the PCB. During production, through the tin climbing effect in the solder, the situation that the thin and soft lead pin of the lamp bead is easy to shift and lead to false welding can be overcome, the large-scale production of welding equipment instead of manual welding can greatly improve the production efficiency, avoid false welding and improve the yield.

It is obvious to those skilled in the art that the disclosure is not limited to the details of the above exemplary embodiments, and the disclosure can be realized in other specific forms without departing from the spirit or basic features of the disclosure. Therefore, from any point of view, the embodiments should be regarded as exemplary and non-limiting. The scope of the disclosure is limited by the appended claims rather than the above description. Therefore, it is intended to include all changes within the meaning and scope of the equivalent elements of the claims in the disclosure. Any reference numerals in the claims shall not be regarded as limiting the claims involved.

In addition, it should be understood that although the description is described according to the embodiments, not each the embodiment contains only one independent technical solution. This description is only for clarity. Those skilled in the art should take the description as a whole, and the technical solutions in each embodiment can also be combined appropriately to form other embodiments that can be understood by those skilled in the art.

What is claimed is:

1. A light emitting diode (LED) lamp string of easy welding, assembly and injection, comprising: at least one rectifier (20) and a plurality of LED modules (10);

wherein the plurality of LED modules (10) are connected in series between positive and negative output ends of the at least one rectifier (20);

wherein each of the plurality of LED modules (10) comprises a first printed circuit board (PCB) (11), the first PCB (11) is provided with a plurality of first welding positions (12), the plurality of first welding positions (12) are welded with a lamp bead (13) and wires (30) thereon, the lamp bead (13) is electrically connected to first ends of the wires (30);

wherein a second end of one of the wires (30) of each of the plurality of LED modules (10) is directly connected to the at least one rectifier (20), or is connected to the at least one rectifier (20) after passing through at least one other LED module (10) of the plurality of LED modules (10); and wherein a number of the at least one rectifier (20) is multiple, the plurality of LED modules (10) are divided into multiple LED module groups, and each of the multiple LED module groups comprises: at least two of the plurality of LED modules (10); each of the multiple LED module groups is directly connected between adjacent two of the multiple rectifiers (20), and adjacent two of the multiple LED module groups are directly connected with one of the multiple rectifiers (20).

2. The LED lamp string according to claim 1, wherein the first PCB (11) is further welded with a resistor (14) thereon, and the resistor (14) is connected in series between one of the wires (30) and the lamp bead (13).

3. The LED lamp string according to claim 2, wherein adjacent two of the plurality of LED modules (10) are connected in series.

4. The LED lamp string according to claim 3, wherein the first PCB (11) is further welded with bypass (BP) diodes (15), and the BP diodes (15) are connected in parallel with the lamp bead (13).

5. The LED lamp string according to claim 1, wherein a number of the at least one rectifier (20) is one, and the one rectifier (20) is a bridge rectifier circuit.

6. The LED lamp string according to claim 1, wherein the adjacent two of the multiple rectifiers (20) together form a bridge rectifier circuit.

7. The LED lamp string according to claim 6, wherein each of the multiple rectifier (20) comprises a second PCB (21), the second PCB (21) is provided with a plurality of second welding positions (22), the plurality of second welding positions (22) are welded with a first diode (23) and a second diode (24), and the first diode (23) and the second diode (24) are arranged in one of an output-to-output manner and an input-to-input manner.

8. The LED lamp string according to claim 1, wherein each of the plurality of LED modules (10) further comprises an insulating housing (16), the first PCB (11) and the lamp bead (13) are embedded and fixed in the insulating housing (16), and the lamp bead (13) is exposed from the insulating housing (16).

9. The LED lamp string according to claim 1, wherein one of the at least one rectifier (20) at one end of the LED lamp string is connected with one of a male plug (40) and a female plug (50), and another of the at least one rectifier (20) at the other end of the LED lamp string is connected with the other one of the male plug (40) and the female plug (50).

10. A method for producing the LED lamp string according to claim 1, wherein the at least one rectifier (20) is a plurality of rectifiers (20) and each of the plurality of rectifiers (20) comprises a second PCB (21), and the method comprises:

forming a metal circuit and the plurality of first welding positions (12) on the first PCB (11), and forming a metal circuit and a plurality of second welding positions (22) on the second PCB (21);

welding a resistor (14) and BP diodes (15) to the plurality of first welding positions of the first PCB (11) through a welding equipment to form a target first PCB, and thereby obtaining a plurality of target first PCBs of the plurality of LED modules (10);

welding a plurality of diodes to the plurality of second welding positions (22) of the second PCB (21) through the welding equipment to form one of the plurality of rectifiers (20) together with the second PCB (21), and thereby obtaining the plurality of rectifiers (20);

placing the plurality of rectifiers (20) and the plurality of target first PCBs on a welding fixture to make the plurality of target first PCBs be located between adjacent two of the plurality of rectifiers (20), and then clamping a plurality of wires (30) and a plurality of lamp beads (13) on the welding fixture; wherein each of the plurality of lamp beads (13) corresponds to ones of the plurality of first welding positions (12) of each of the plurality of target first PCBs, and each of the plurality of wires (30) comprises a plurality of connecting ends, and the plurality of connecting ends of the plurality of wires (30) correspond to different ones of the plurality of first welding positions (12) of the plurality of target first PCBs and the plurality of second welding positions (22) of the plurality of second PCBs (20); and welding each of the plurality of lamp beads (13) to the ones of the plurality of first welding positions of corresponding one of the plurality of target first PCBs through the welding equipment, and welding the plurality of connecting ends of the plurality of wires (30) to the different ones of the plurality of first welding positions (12) of the plurality of target first PCBs and the plurality of second welding positions (22) of the plurality of second PCBs (20).

11. The LED lamp string according to claim 1, wherein the multiple LED module groups are connected in parallel with each other.

12. The LED lamp string according to claim 1, wherein the multiple LED module groups are connected in series with each other.

13. The LED lamp string according to claim 1, wherein the plurality of first welding positions (12) comprises a first welding position, a second welding position, a third welding position and a fourth welding position; the lamp bead (13) is directly connected between the first welding position and the second welding position; the wires (30) are directly connected with the third welding position and the fourth welding position respectively; and the first to fourth welding positions are different.

14. The LED lamp string according to claim 2, wherein the plurality of first welding positions (12) comprises a first welding position, a second welding position, a third welding position and a fourth welding position, which are different from each other; the lamp bead (13) is directly connected between the first welding position and the second welding position; the wires (30) are directly connected with the third welding position and the fourth welding position respectively; and the resistor (14) is directly connected between the second welding position and the fourth welding position.

15. The LED lamp string according to claim 4, wherein the plurality of first welding positions (12) comprises first to fourth welding positions which are different from each other; the lamp bead (13) is directly connected between the first welding position and the second welding position; the wires (30) are directly connected with the third welding position and the fourth welding position respectively; the resistor (14) is directly connected between the second welding position and the fourth welding position; the BP diodes (15) form a diode alternating current (DIAC) switch; the DIAC switch is directly connected between the first welding position and the second welding position and connected in series with the resistor (14), or the DIAC switch is directly connected between the third welding position and the fourth welding position and connected in parallel with the lamp bead (13) and the resistor (14).

* * * * *